United States Patent [19]

Sutton et al.

[11] Patent Number: 4,574,406

[45] Date of Patent: Mar. 11, 1986

[54] TUB COMFORTER

[76] Inventors: Bernard Sutton; George Spector, both of 233 Broadway Rm 3615, New York, N.Y. 10007

[21] Appl. No.: 595,955

[22] Filed: Apr. 2, 1984

[51] Int. Cl.[4] ..... A47K 3/022; A47K 3/12

[52] U.S. Cl. ..... 4/559; 4/571; 4/573; 4/575; 4/578

[58] Field of Search ..... 4/571, 573, 575, 578, 4/579, 443, 444, 559, 515, 519, 523, 528

[56] References Cited

U.S. PATENT DOCUMENTS

| | | | |
|---|---|---|---|
| D. 259,274 | 5/1981 | Humes | 4/575 X |
| 1,676,354 | 7/1928 | Sachsse | 4/575 |
| 2,167,178 | 7/1939 | Kohlstadt | 4/575 |
| 2,582,439 | 1/1952 | Kavanagh | 4/575 X |
| 2,985,889 | 5/1961 | Fain et al. | 4/575 |
| 3,078,474 | 2/1963 | Chaitlen | 4/575 |
| 3,292,186 | 12/1966 | Turmenne et al. | 4/519 |
| 3,377,630 | 4/1968 | Robare | 4/444 |
| 3,648,296 | 3/1972 | Craft et al. | 4/444 |

FOREIGN PATENT DOCUMENTS

| | | | |
|---|---|---|---|
| 12775 | 7/1903 | Austria | 4/573 |
| 2053673 | 2/1981 | United Kingdom | 4/571 |

*Primary Examiner*—Henry K. Artis

[57] ABSTRACT

A tub comforter is provided and consists of a contoured shaped seat, a head-neck supporter and a base pad. It is designed to provide comfort and support to the head, the neck, the back, the arms, the buttock and the thighs of a human body while seated in a bathtub.

5 Claims, 5 Drawing Figures

TUB COMFORTER

BACKGROUND OF THE INVENTION

This instant invention relates generally to bathtub seats and more specifically it relates to a tub comforter to accommodate a person while seated in a bathtub.

The standard tub installed in the greater majority of homes and apartments does not permit a person to sit and relax or lean back in comfort. The person will either slide forward, develop lower back discomfort from sitting straight up or the tub edge will poke into the back with the head on the wall.

Numerous bathtub seats have been provided in prior art that are adapted to support a person while bathing. For example, U.S. Pat. Nos. 2,582,439; 2,985,889 and 3,005,208 all are illustrative of such prior art. While these units may be suitable for the particular purposes to which they address, they would not be suitable for the purposes of the present invention, as heretofore described.

SUMMARY OF THE INVENTION

A principle object of the present invention is to provide a tub comforter that will provide comfort and support to six parts of the human body being the head, the neck, the back, the arms, the buttock and the thighs.

Another object is to provide a tub comforter that consists of two basic parts being a contoured shaped seat and a head-neck supporter.

An additional object is to provide a tub comforter that has a device for adjusting the head-neck supporter in relationship to the contoured shaped seat for different heights of its users.

A further object is to provide a tub comforter that is simple and easy to use.

A still further object is to provide a tub comforter that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
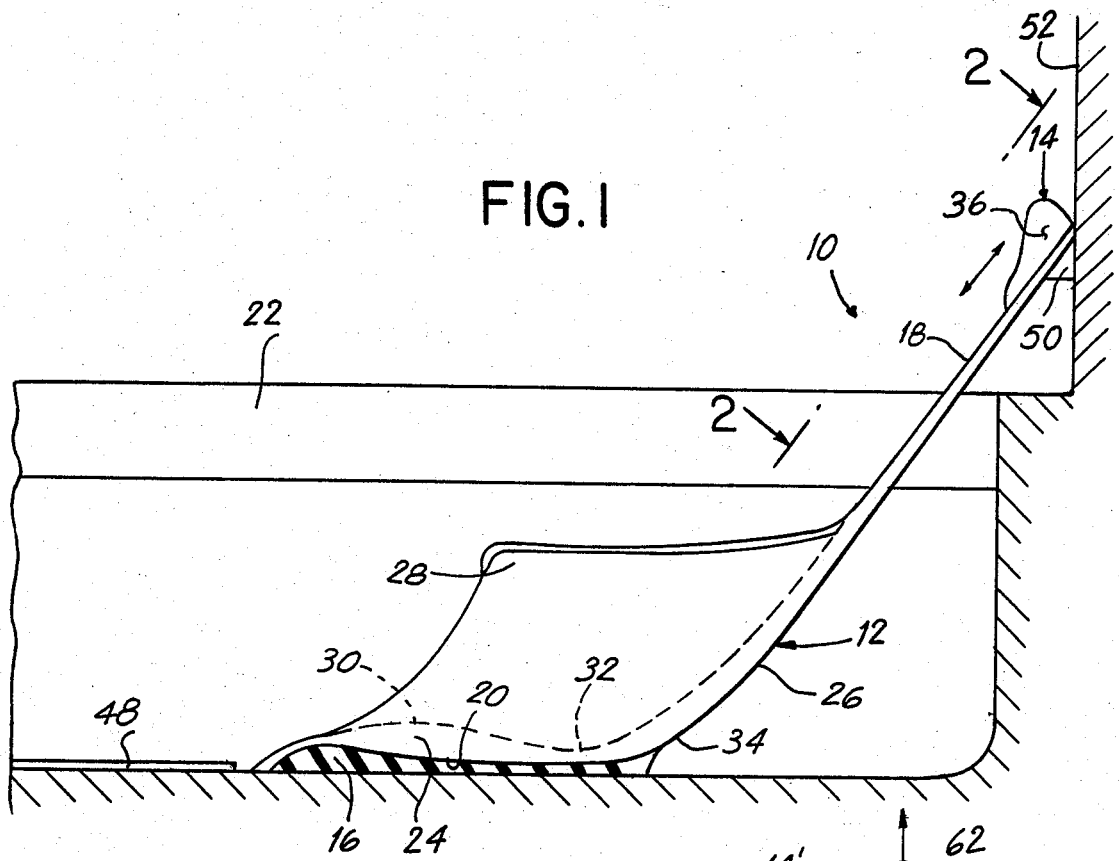
FIG. 1 is a side view (partly in cross section) of the ivention in a bathtub with the bathtub broken away and in cross section.
Figure 3:
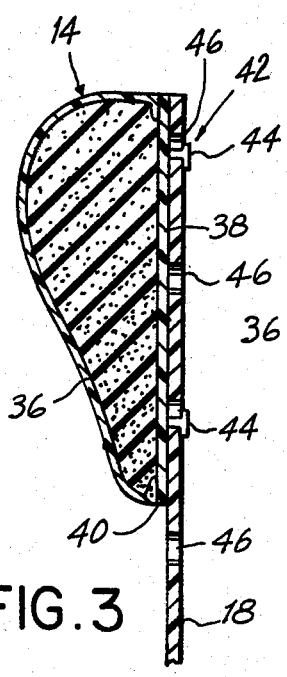
FIG. 3 is a cross sectional view taken along line 3—3 in FIG. 2.
Figure 2:
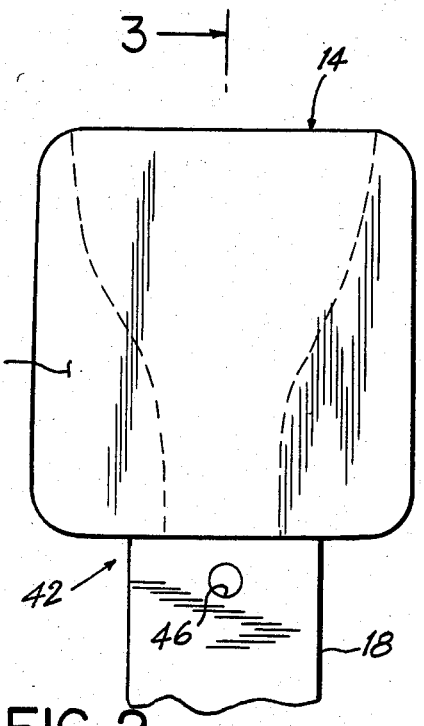
FIG. 2 is a partial front view taken along line 2—2 in FIG. 1.

Turning now descriptively to the drawings, in which similar reference characters denote similar elements throughout the several views, FIGS. 1 through 3 illustrates a tub comforter 10 that consists of a contoured shaped seat 12, a head-neck supporter 14 and a base pad 16.

The contoured shaped seat 12 is to provide comfort and support to back, arms, buttock and thighs of a human body (not shown). The head-neck supporter 14 is affixed to back portion 18 of the seat 12 to provide comfort and support to head and neck of the human body (not shown). The base pad 16 is affixed to underside 20 of the seat 12. When the seat 12 is placed into a bathtub 22 the base pad 16 will provide support to the seat 12 and keep the seat positioned thereto.

The contoured shaped seat 12 consists of a base member 24, a back member 26 and a pair of arm members 28.

The base member 24 is slightly elevated at 30 in front forming a cup 32 forming a cup for the buttock and support for the thighs preventing the human body from sliding forward. The back member 26 is joined at an incline to one end 34 of the base member 24. The back member 26 is designed to the shape of the human back for support thereon. Each arm member 28 is joined to the back member 26 and the base member 24 to support one arm of the human body.

The contoured shaped seat 12 is made from hard plastic to provide for flexibility and material durability so that water, soap, shampoo and bath oil will not cause progressive damage from repeated use.

The head-neck supporter 14 is made of vinyl material 36 over a contoured shape of foam rubber 38 mounted to a plate 40. The base pad 16 is made of foam rubber.

A device 42 is provided for adjusting the head-neck supporter 14 in relationship to the contoured shaped seat 12 for different heights of the human body. The device 42 consists of a pair of vertically spaced hooks 44 mounted to the plate 40 of the head-neck supporter 14. The back portion 18 of the seat 12 has a plurality of vertical spaced apertures 46 so that the hooks 44 will fit into any two apertures 46 therein.

The tub comforter 10 can also come with a rubber tub mat 48 which will prevent slipping when entering or exiting the tub 22. A rubber wedge piece 50 can also be mounted to rear surface of the back portion 18 of the seat 12 so that the back portion can engage bathtub wall 52 and prevent slippage.

Figure 4:
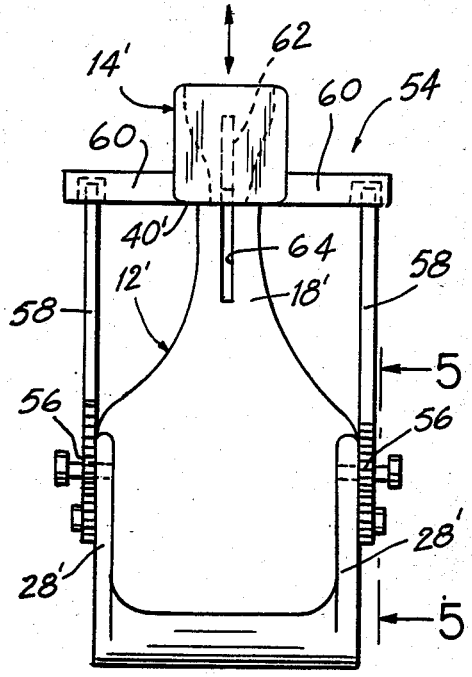
FIG. 4 is a front view of a modification of the invention showing a gear means for adjusting the position of a head rest.
Figure 5:
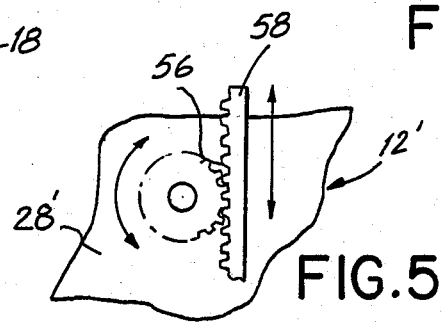
FIG. 5 is a cross sectional view taken along line 5—5 in FIG. 4 showing details of said adjusting means.

FIGS. 4 and 5 show another device 54 for adjusting the head-neck supporter 14' in relationship to the contoured shaped seat 12' for different heights of the human body. The device 54 consists of a pair of spur gears 56, a pair of vertical racks 58, a pair of horizontal bars 60, a vertical slide bar 62 and the back member 18' of the seat 12' having a vertical slot 64.

Each spur gear 56 is rotatably mounted to side of one arm member 28'. Each vertical rack 58 is slidably mounted to a side of one arm member 28' to engage one spur gear 56. Each horizontal bar is affixed to one side of the plate 40' of the head-neck supporter 14'. The vertical slide bar 62 is affixed to back of the plate 40' of the head-neck supporter 14'.

The vertical slide bar 62 can travel up and down within the vertical slot 64 when the spur gears 56 are turned manually moving the vertical racks 58 moving the horizontal bars 60 up and down.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

We claim:

1. A tub comforter which comprises:

a. a contoured shaped seat and back adapted to provide comfort and support to back, arms, buttock and thighs of a human body;

b. a soft head support adjustably affixed on said back seat to provide comfort and support to the head and neck of a person; and c. a base pad affixed to the underside of said seat so that when said seat is placed into a bathtub said base pad will provide frictional support to said seat and keep said seat from slipping; and d. said seat being elevated in front and recessed rearwardly forming a cup for the buttock and support for the thighs preventing the user from sliding forward; said pad being similarly contoured to fit said seat and providing a flat bottom;

e. said back extending at an incline to one end of said seat, said back being contoured to shape of the human back for support thereon; and f. a pair of arms each said arm joined to said back and said seat.

2. A tub comforter as recited in claim 1, wherein said contoured seat and back is formed integrally from a relatively stiff material which can flex sufficiently to comfortably support the user.

3. A tub comforter as recited in claim 1, further comprising a a means for adjusting said head-neck supporter in relationship to said contoured shaped seat for differently dimensioned users, wherein said means for adjusting said head-neck supporter comprises:

a. vertically spaced hooks mounted on said supporter; and b. said back portion of said seat having a plurality of vertical spaced apertures to accept said hooks at varying locations.

4. A tub comforter as recited in claim 1, wherein said means for adjusting said head-neck supporter comprises:

a. an assembly adjustably mounted on said arms, said head support being affixed to said assembly; and b. an actuating device mounted on said arms coacting with said assembly to adjust the position of said assembly and said support;

c. a guide on said support slideable in a slot on said back for supportingly guiding said head support to various positions relative to said back.

5. A comforter as in claim 4, said assembly and guide comprising;

a. a pair of spur gears, each rotatably mounted to side of one said arm member;

b. a pair of vertical racks, each slideably mounted to side of one said arm member to engage one said spur gear;

c. a pair of horizontal bars, each affixed to side of said plate of said head-neck supporter;

d. a vertical slide bar affixed to back of said plate of said head-neck supporter; and e. said back member of said seat having a vertical slot so that said vertical slide bar can travel up and down with the vertical slot when said spur gears are turned manually saving said vertical racks moving said horizontal bars up and down.

* * * * *